US009635475B2

(12) United States Patent
Polinske et al.

(10) Patent No.: US 9,635,475 B2
(45) Date of Patent: Apr. 25, 2017

(54) HEARING ASSISTANCE DEVICE WITH BALANCED FEED-LINE FOR ANTENNA

(71) Applicant: Starkey Laboratories, Inc., Eden Prairie, MN (US)

(72) Inventors: Beau Jay Polinske, Minneapolis, MN (US); Nasser Thomas Pooladian, Roseville, MN (US); Jay Rabel, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/267,676

(22) Filed: May 1, 2014

(65) Prior Publication Data

US 2015/0036854 A1 Feb. 5, 2015

Related U.S. Application Data

(60) Provisional application No. 61/818,375, filed on May 1, 2013.

(51) Int. Cl.

| | |
|---|---|
| ***H04R 25/00*** | (2006.01) |
| ***H01Q 1/27*** | (2006.01) |
| ***H01Q 7/00*** | (2006.01) |

(52) U.S. Cl.

CPC ..... *H04R 25/554* (2013.01); *H01Q 1/273* (2013.01); *H01Q 7/00* (2013.01); *H04R 25/30* (2013.01);

(Continued)

(58) Field of Classification Search

CPC ..... H04R 25/02; H04R 25/30; H04R 25/55; H04R 25/554; H04R 25/658; H04R 25/60;

(Continued)

(56) References Cited

U.S. PATENT DOCUMENTS 4,150,262 A 4/1979 Ono
5,692,059 A 11/1997 Kruger (Continued)

FOREIGN PATENT DOCUMENTS

DK EP 2986030 A1 * 2/2016 ..... H01Q 1/273

OTHER PUBLICATIONS

"Method of Measurement of Performance Characteristics of Hearing Aids Under Simulated Real-Ear Working Conditions, Table C.1", ANSI/ASA S3.35-2010, (2010), 47-47.

(Continued)

*Primary Examiner* — Curtis Kuntz

*Assistant Examiner* — Joshua Kaufman

(74) *Attorney, Agent, or Firm* — Schwegman, Lundberg & Woessner, P.A.

(57) ABSTRACT

A hearing assistance device, such as a hearing aid, includes an antenna connected to a communication circuit through a feed-line for wireless communication. The antenna and the feed-line are configured and placed such that capacitance between their conductors is approximately minimized. In one embodiment, the feed-line includes feed-line conductors each including a major portion approximately perpendicular to an antenna conductor. In another embodiment, the feed-line includes a feed-line conductor crossing the antenna conductor, and at least one of the antenna conductor and the feed-line conductor includes a notch in the crossing area to reduce the crossing area.

17 Claims, 6 Drawing Sheets

(52) U.S. Cl.
CPC ..... *H04R 25/608* (2013.01); *H04R 2225/021* (2013.01); *H04R 2225/51* (2013.01)

(58) Field of Classification Search
CPC ..... H04R 25/604; H04R 2225/021; H04R 2225/55; H04R 2225/51; H04R 2225/49; H04R 2225/77
USPC ..... 381/23.1, 60, 151, 312, 315, 322, 324, 381/330, 331; 343/700 MS, 720, 866, 343/867; 600/25
See application file for complete search history.

(56) References Cited

U.S. PATENT DOCUMENTS

| | | | | |
|---|---|---|---|---|
| 5,812,659 | A | 9/1998 | Mauney et al. | |
| 6,754,359 | B1 | 6/2004 | Svean et al. | |
| 7,477,754 | B2 | 1/2009 | Rasmussen et al. | |
| 7,502,484 | B2 | 3/2009 | Ngia et al. | |
| 7,593,538 | B2 | 9/2009 | Polinske | |
| 2005/0099341 | A1* | 5/2005 | Zhang et al. | 343/700 MS |
| 2006/0227989 | A1* | 10/2006 | Polinske | 381/322 |
| 2007/0127757 | A2 | 6/2007 | Darbut et al. | |
| 2008/0095387 | A1* | 4/2008 | Niederdrank et al. | 381/314 |
| 2010/0158291 | A1* | 6/2010 | Polinske et al. | 381/315 |
| 2010/0158293 | A1* | 6/2010 | Polinske et al. | 381/315 |
| 2010/0158295 | A1* | 6/2010 | Polinske et al. | 381/323 |
| 2010/0260364 | A1 | 10/2010 | Merks | |
| 2011/0135120 | A1 | 6/2011 | Larsen et al. | |
| 2011/0243385 | A1 | 10/2011 | Nishino | |
| 2013/0069830 | A1* | 3/2013 | Chen et al. | 343/700 MS |
| 2014/0010392 | A1* | 1/2014 | Kvist | 381/315 |
| 2014/0010393 | A1* | 1/2014 | Kvist | 381/315 |
| 2014/0010394 | A1* | 1/2014 | Kvist | 381/315 |
| 2015/0036854 | A1* | 2/2015 | Polinske et al. | 381/315 |
| 2015/0049891 | A1* | 2/2015 | Johnson et al. | 381/315 |

OTHER PUBLICATIONS

Mather, G., "Perception of Sound (p. 125)", Foundations of Perception, Taylor & Francis, ISBN 0863778356, (2006), 125-125.

* cited by examiner

HEARING ASSISTANCE DEVICE WITH BALANCED FEED-LINE FOR ANTENNA

CLAIM OF PRIORITY

The present application claims the benefit of priority under 35 U.S.C. §119(e) of U.S. Provisional Patent Application Ser. No. 61/818,375, filed on May 1, 2013, which application is incorporated herein by reference in its entirety.

TECHNICAL FIELD

This document relates generally to hearing assistance systems and more particularly to a hearing assistance device that includes an antenna for wireless communication and a balanced feed-line connecting the antenna to a communication circuit.

BACKGROUND

Hearing aids are used to assist patients suffering hearing loss by transmitting amplified sounds to ear canals. The sounds may be detected from a patient's environment using the microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and easy to maintain. The hearing aids may each include an antenna for the wireless communication. Given the spatial restrictions, likely accompanied by low-power requirements and interference between various metal parts in the hearing aid, there is a need for providing the hearing aid with a stable and reliable wireless communication system without increasing the size and power consumption of the hearing aid.

SUMMARY

A hearing assistance device, such as a hearing aid, includes an antenna connected to a communication circuit through a feed-line for wireless communication. The antenna and the feed-line are configured and placed such that capacitance between their conductors is approximately minimized. In one embodiment, the feed-line includes feed-line conductors each including a major portion approximately perpendicular to an antenna conductor. In another embodiment, the feed-line includes a feed-line conductor crossing the antenna conductor, and at least one of the antenna conductor and the feed-line conductor includes a notch in the crossing area to reduce the crossing area.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing assistance device including an antenna that is connected to a communication circuit through a balanced feed-line (transmission line) for wireless communication with another device. Feed-line-related factors that affect performance of the wireless communication may include, but are not be limited to, feed-line capacitance and loss, electrical imbalance, unwanted interaction with the antenna, and/or radiated harmonic emissions. Some antenna and feed-line configurations each may address part of the problems or address one problem while causing or worsening another. For example, connecting the feed-line from sides of the antenna may reduce feed-line capacitance while increasing electrical imbalance and level of radiated harmonic emissions. Crossing between antenna and feed-line conductors may introduce a fixed differential capacitance that cannot be adjusted to optimize the performance of wireless communication. The present subject matter provides a balanced feed-line to connect the antenna to the communication circuit to allow for optimization of the performance of the wireless communication. In various embodiments, geometry of the feed-line and placement of the feed-line relative to the antenna are determined to reduce or minimize feed-line capacitance and loss, electrical imbalance, unwanted interaction between the feed-line and the antenna, and/or radiated harmonic emissions when the present subject matter is applied to the hearing assistance device, such as a hearing aid.

Figure 1:
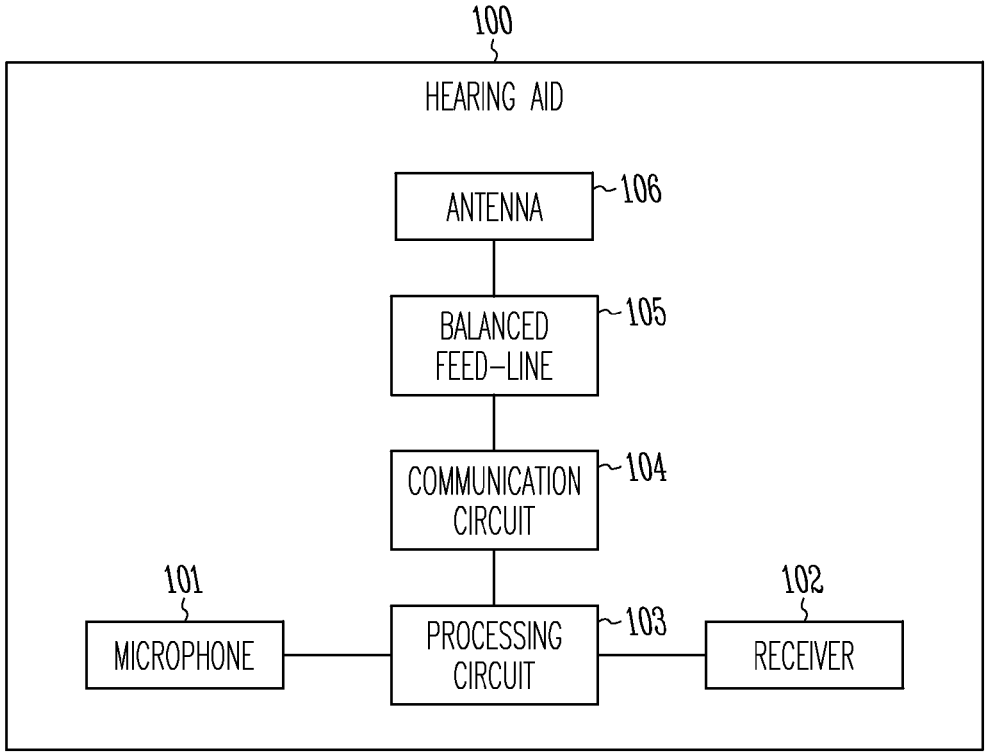
FIG. 1 is a block diagram illustrating of an embodiment of portions of a hearing aid.

FIG. 1 is a block diagram illustrating of an embodiment of portions of a hearing aid 100. Hearing aid 100 includes a microphone 101, a receiver (speaker) 102, a processing circuit 103, a communication circuit 104, a balanced feed-line (transmission line) 105, and an antenna 106. Microphone 101 receives sounds from the environment of the hearing aid wearer (wearer of hearing aid 100). Communication circuit 104 includes a radio circuit that communicates with another device wirelessly, including receiving programming codes, streamed audio signals, and/or other audio signals and transmitting programming codes, audio signals, and/or other signals. Processing circuit 103 controls the operation of hearing aid 100 using the programming codes and processes the sounds received by microphone 101 and/or the audio signals received by communication circuit 104 to produce output sounds. Receiver 102 transmits output sounds to an ear canal of the hearing aid wearer.

Antenna 106 is connected to communication circuit 104 through feed-line 105 to receive signals from, and transmits signals to, another device. In various embodiments, feed-line 105 carries radio-frequency (RF) signals for the wireless communication and includes a gradual transition from one section to another section of RF circuitry. This gradual transition substantially removes RF discontinuities, which can degrade performance of the wireless communication.

Feed-line 105 has a geometry and placement determined to ensure quality of the wireless communication. In one embodiment, a "flare-out" approach to the feed-line geometry and placement avoids crossover of differential lines that causes parasitic capacitance by configuring the planes of conductors of antenna 106 and feed-line 105 to be normal to each other, rather than a configuration, for example, where the plane of a feed-line conductor may be parallel to the plane of an antenna conductor. In another embodiment, a "neck-down" approach to the feed-line geometry and placement reduces parasitic capacitance by reducing the exposure (overlapping or crossing area) of a feed-line conductor on to an antenna conductor when the plane of the feed-line conductor is parallel to the plane of the antenna conductor. In various embodiments, the conductors of antenna 106 and feed-line 105 (i.e., the antenna conductor(s) and the feed-line conductor(s)) are each a conductive trace (e.g., a metal trace such as a copper trace) on a flex circuit substrate. The "neck-down" approach may be applied, for example, when implementation of the "flare-out" approach is difficult due to the size and space constraints in the design of the hearing assistance device. Various embodiments of feed-line 105 and its placement relative to antenna 106 are discussed by way of example, but not by way of restriction, with reference to FIGS. 2-7.

Figure 2:
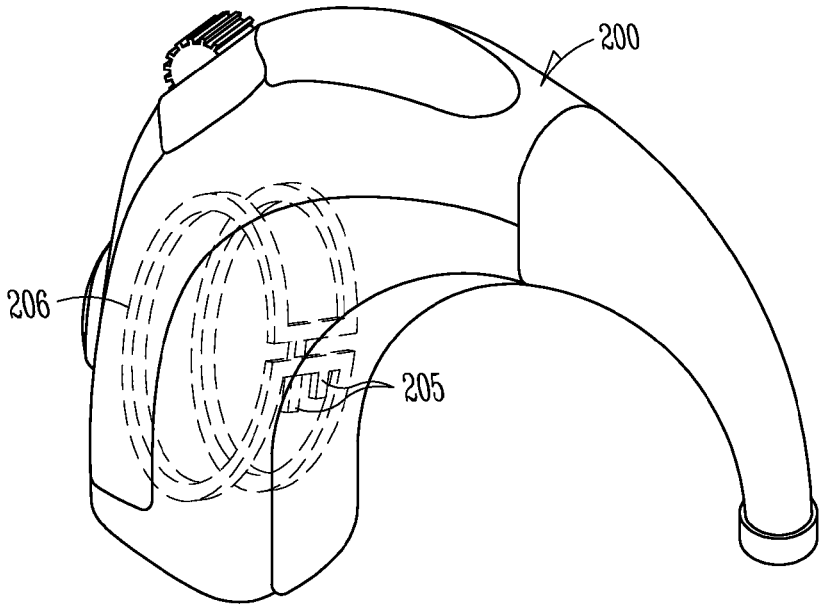
FIG. 2 is an illustration of an embodiment of the hearing aid showing its antenna and feed-line for the antenna.

FIG. 2 is an illustration of an embodiment of a hearing aid 200 showing an antenna 206 and a feed-line 205 for the antenna. Hearing aid 200 represents an embodiment of hearing aid 100. Antenna 206 represents an embodiment of antenna 106 and allows for the wireless communication between hearing aid 200 and another device. In the illustrated example, hearing aid 200 is a behind-the-ear (BTE) type hearing aid, and antenna 206 is a parallel-loop type antenna housed in the case of hearing aid 200. While the BTE type hearing aid and parallel-loop antenna are illustrated as an example, the present subject matter is applicable to any type hearing aid or other hearing assistance device with any type of antenna suitable for use in the hearing aid or other hearing assistance device. Examples of antenna 205 include those discussed in U.S. patent application Ser. No. 12/638,720, entitled "PARALLEL ANTENNAS FOR STANDARD FIT HEARING ASSISTANCE DEVICES", filed on Dec. 15, 2009, published as US 2010/0158293, U.S. patent application Ser. No. 12/340,604, entitled "ANTENNAS FOR STANDARD FIT HEARING ASSISTANCE DEVICES", filed on Dec. 15, 2008, published as US 2010/0158291, U.S. patent application Ser. No. 12/340,600, entitled "ANTENNAS FOR CUSTOM FIT HEARING ASSISTANCE DEVICES", filed on Dec. 19, 2008, published as US 2010/0158295, and U.S. Pat. No. 7,593,538, entitled "ANTENNAS FOR HEARING AIDS", all assigned to Starkey Laboratories, Inc., which are incorporated herein by reference in their entirety. Feed-line 205 represents an embodiment of feed-line 105 and includes a pair of differential lines connecting antenna 206 to a communication circuit (not shown) of hearing aid 200.

Figure 3:
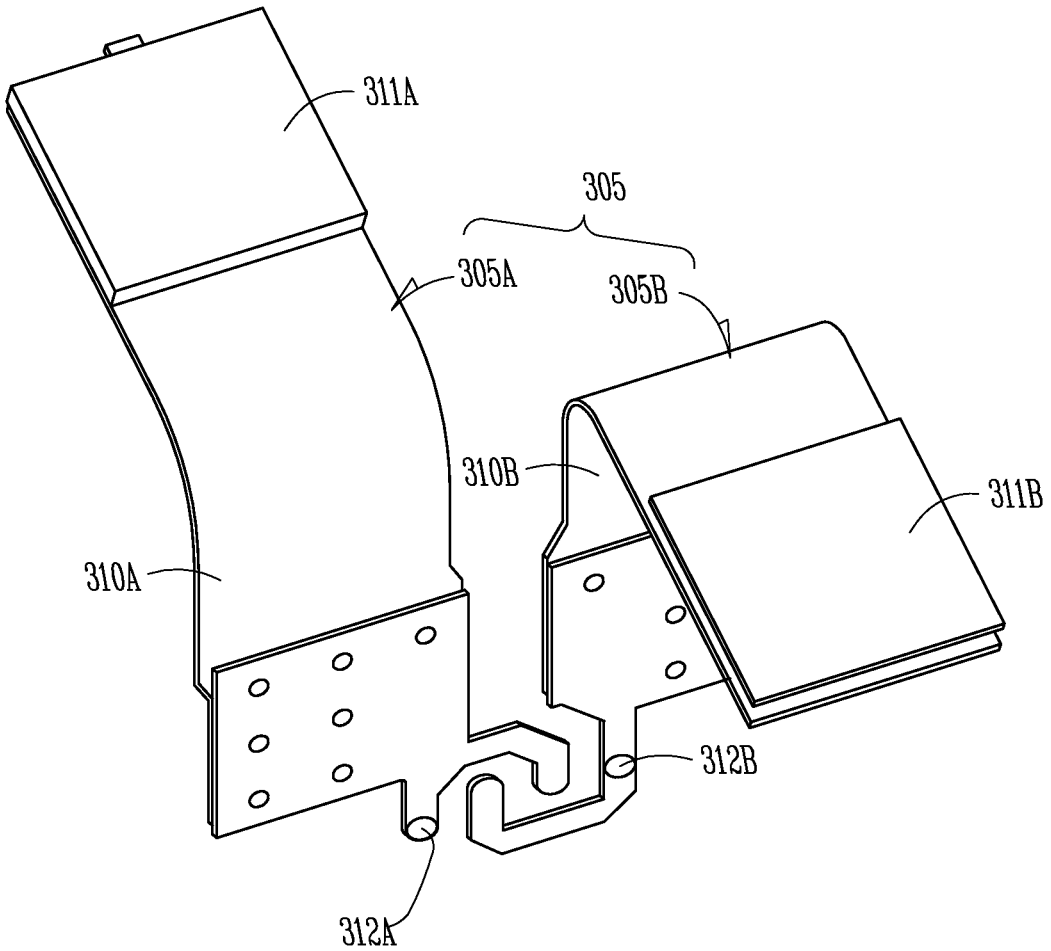
FIG. 3 is an illustration of an embodiment of the feed-line.

FIG. 3 is an illustration of an embodiment of a feed-line 305. Feed-line 305 represents an embodiment of feed-line 105 using the "flare-out" approach, which is designed to minimize the RF discontinuity at the feed-point, minimize antenna feed-point losses, and maximize performance a parallel-loop type antenna. Feed-line 305 includes feed-line branches (differential lines) 305A and 305B configured to be connected to the differential output of communication circuit 104. Feed-line conductor 305A includes a conductor 310A coupled between an antenna pad 311A for making connection to antenna 105 and an RF integrated circuit (RFIC) pad 312A for making connection to communication circuit 104. Feed-line conductor 305B includes a conductor 310B coupled between an antenna pad 311B for making connection to antenna 105 and an RFIC pad 312B for making connection to communication circuit 104. Conductors 310A and 310B have substantially the same length (physically and electrically) when using the architecture illustrated in FIG. 3. In one embodiment, conductors 310A and 310B are each a metal (such as copper) trace on a flex circuit substrate. The narrow portions of each of conductors 310A and 310B connect RFIC pads 312A and 312B, respectively, in parallel. The other portions of conductors 310A and 310B are substantially equal length and symmetric wherever possible. In various embodiments, the length of each of conductors 310A and 310B is approximately minimized to reduce power loss. The length of each of conductors 310A and 310B is also approximately minimized, and the width of each of conductors 310A and 310B is determined for low resistance and inductance. The spacing between conductors 310A and 310B is determined by balancing between field containment and differential impedance (capacitance). Major portions of conductors 310A and 310B are approximately perpendicular to the mating antenna conductors to minimize coupling and degradation of the performance of the wireless communication and are centered in the space between the antenna connection points, as illustrated in FIGS. 4 and 5, which shows examples of feed-line 305 connected to a parallel-loop (butterfly) antenna and a band antenna, respectively.

Figure 4:
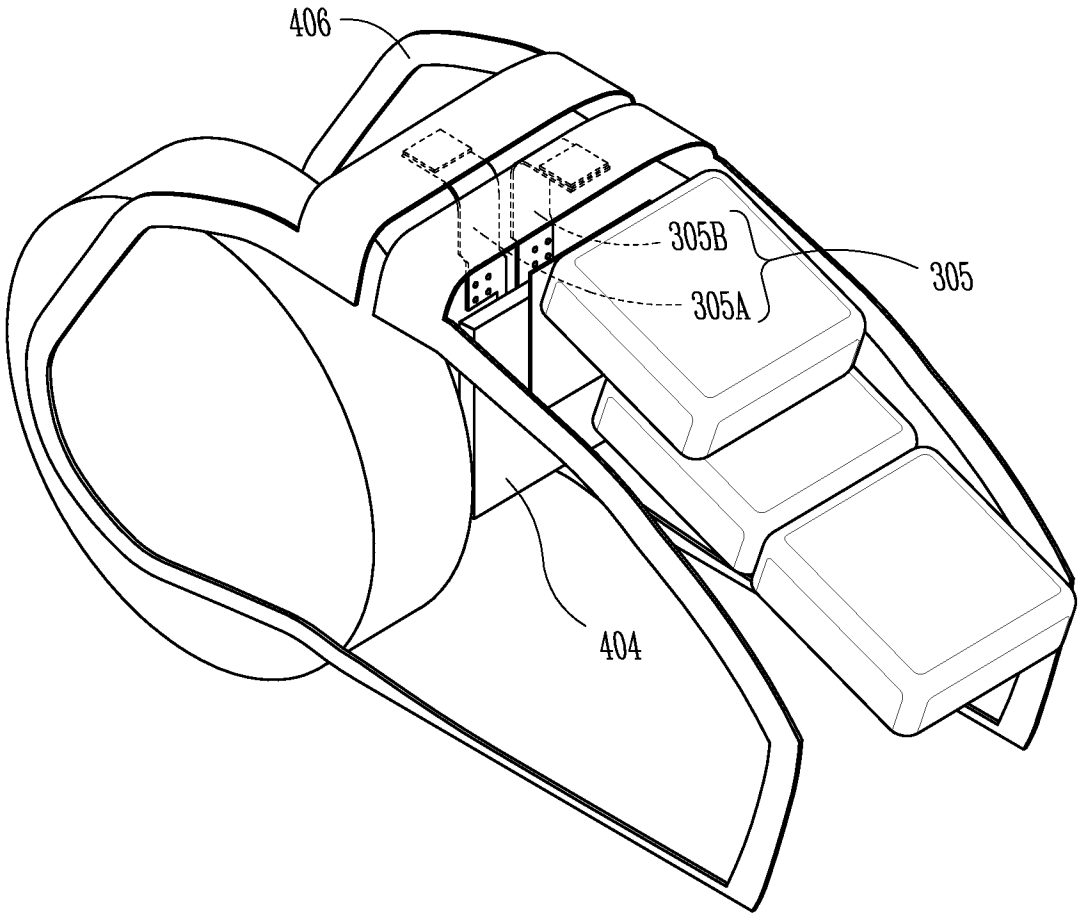
FIG. 4 is an illustration of an embodiment of the feed-line connected to a parallel loop antenna.

FIG. 4 is an illustration of an embodiment of feed-line 305 connected to a parallel loop antenna 406. Antenna 406 represents an embodiment of antenna 106. FIG. 4 shows feed-line branches 305A and 305B each connected between antenna 406 and a communication circuit 404 that represents an embodiment of communication circuit 104. When assembled as illustrated, 305A and 305B each include a major portion approximately perpendicular to the conductor of antenna 406, including various segments of the conductor. In one embodiment, 305A and 305B each include a major portion approximately perpendicular to the conductor of antenna 406 at least at, or in the proximity of, its connection point with antenna 406. In one embodiment, antenna 406 is a flex circuit antenna including the conductor trace on a flex circuit substrate. An example of such a flex circuit antenna is discussed in U.S. patent application Ser. No. 12/638,720, entitled "PARALLEL ANTENNAS FOR STANDARD FIT HEARING ASSISTANCE DEVICES", filed on Dec. 15, 2009, published as US 2010/0158293, assigned to Starkey Laboratories, Inc., which is incorporated herein by reference in its entirety.

Figure 5:
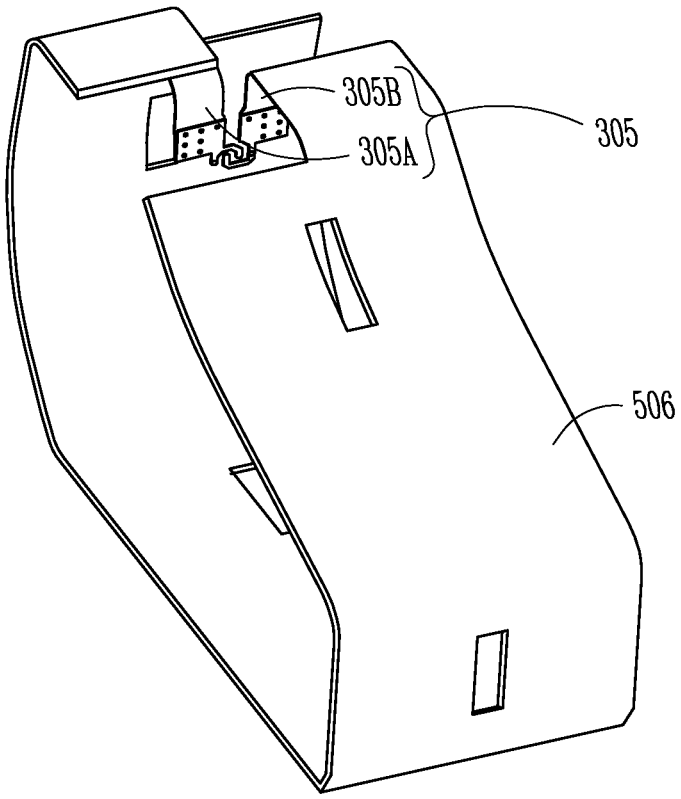
FIG. 5 is an illustration of an embodiment of the feed-line connected to a band antenna.

FIG. 5 is an illustration of an embodiment of feed-line 305 connected to a band antenna 506. Antenna 506 represents another embodiment of antenna 106. FIG. 5 shows feed-line branches 305A and 305B each connected to antenna 506. When assembled as illustrated, feed-line branches 305A and 305B each include a major portion approximately perpendicular to the conductor of antenna 506, at least at, or in the proximity of, its connection point with antenna 506.

Figure 6:
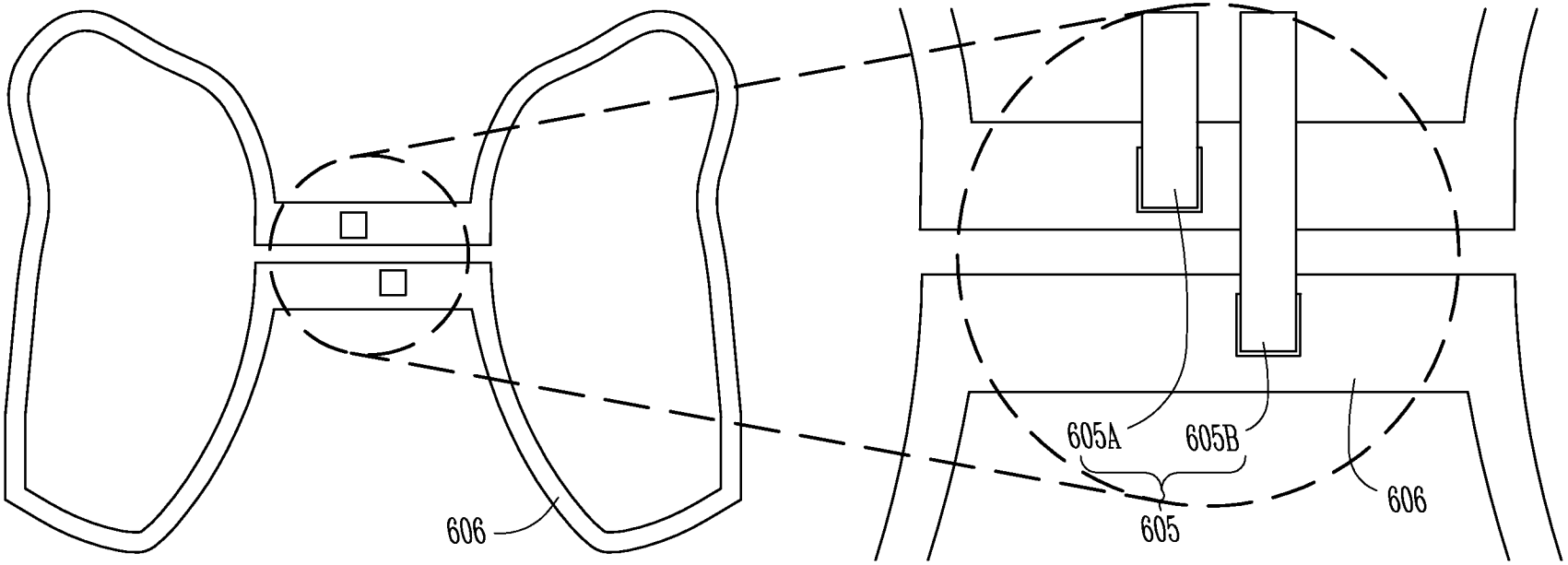
FIG. 6 is an illustration of another embodiment of the feed-line connected to a parallel loop antenna.

FIG. 6 is an illustration of an embodiment of a feed-line 605 connected to a parallel loop antenna 606. Feed-line 605 represents an embodiment of feed-line 105 and includes feed-line branches (differential lines) 605A and 605B. Antenna 606 as illustrated in FIG. 6 includes a conductor trace (such as copper trace) shown in an unfolded (flattened) state. FIG. 6 illustrates an example in which the "flare-out" approach, such as the examples illustrated in FIGS. 4 and 5, is difficult to implement in certain hearing assistance devices, such as when a crossover between conductors of at least one of feed-line branches 605A and 605B (605B as shown) and antenna 606 becomes inevitable. In one embodiment, the area of the crossover is reduced or minimized to reduce or minimize the capacitance resulting from it, such as using the "neck-down" approach as illustrated in FIG. 7.

Figure 7:
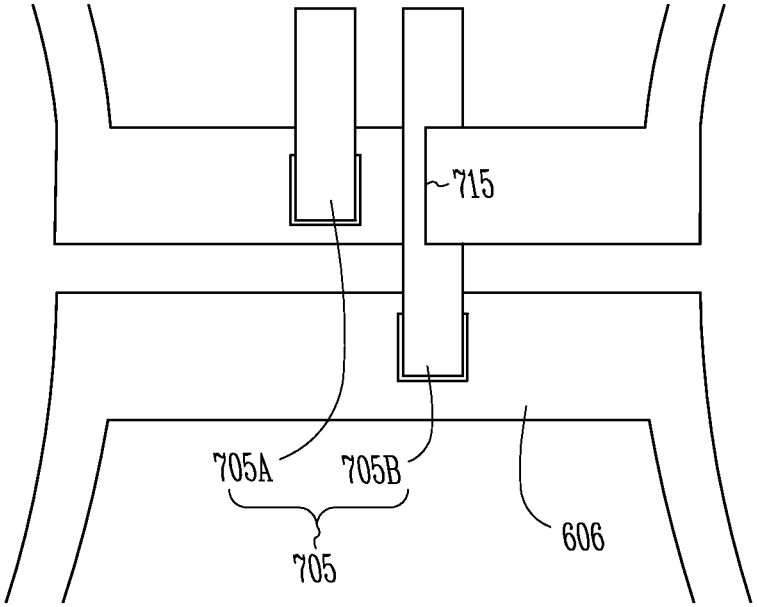
FIG. 7 is an illustration of another embodiment of the feed-line connected to the parallel loop antenna of FIG. 6.

FIG. 7 is an illustration of an embodiment of a feed-line 705 connected to parallel loop antenna 606 using the "neck-down" approach, which introduces a reduced feed-line conductor width in the crossing area to reduce line-to-line capacitance while minimizing path length differences. Feed-line 705 represents an embodiment of feed-line 105 and includes feed-line branches (differential lines) 705A and 705B. FIG. 7 illustrates an example in which feed-line branch 705B crosses a segment of antenna 606. To reduce or minimize the crossing area, feed-line branch 705B includes a notch 715 to be placed over antenna 606 at the crossing area. In other words, the conductor width of feed-line branch 705B at the crossing area is reduced or minimized. In one embodiment, one or more dimensions of notch 715 (such as the conductor width of feed-line branch 705B at the crossing area) are determined by balancing the capacitance resulting from the crossover and the resistive loss while optimizing radiation efficiency of antenna 606 with feed-line 705.

In another embodiment, a notch similar to notch 715 may be introduced into antenna 606, instead of feed-line branch 705B, at the crossing area. In various embodiments, one or more notches similar to notch 715 may be introduced to one or more conductors of one or more of antenna 606 and feed-line 705 at their crossing area(s).

The present subject matter is demonstrated for hearing assistance devices, including hearing aids, including but not limited to, invisibly-in-canal (IIC), completely-in-canal (CIC), in-the-canal (ITC), in-the-ear (ITE), BTE, or receiver-in-canal (RIC) type hearing aids. It is understood that BTE type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices, wireless earphones, and wireless ear buds. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for wireless communication with a hearing aid, comprising:

providing a hearing aid with a parallel-loop antenna including an antenna conductor having loop portions and connecting portions each connecting between the loop portions, the loop portions each having a loop plane, the connecting portions each having a connecting plane approximately perpendicular to each of the loop planes;

providing the hearing aid with a communication circuit configured to perform the wireless communication using the antenna;

providing a feed-line including two branches each including an antenna pad for making connection to the antenna, a circuit pad for making a connection to the communication circuit, and a feed-line conductor coupled between the antenna pad and the circuit pad and having a plane; and reducing capacitance resulting from crossover of conductors and reducing electrical imbalance associated with the feed-line, by connecting the antenna to the communication circuit with major portions of the planes of the feed-line conductors each approximately perpendicular to each of the loop planes of the antenna conductor and approximately perpendicular to each of the connecting planes of the antenna conductor and with the major portions of the planes of the feed-line conductors centered at a space between connection points between the antenna and the feed-line conductors.

2. The method of claim 1, wherein providing the feed-line comprises providing the two branches including the feed-line conductors having substantially equal lengths.

3. The method of claim 2, further comprising minimizing the lengths of the feed-line conductors of the two branches.

4. The method of claim 3, wherein providing the hearing aid with the antenna comprises providing a behind-the-ear (BTE) type hearing aid with the antenna.

5. The method of claim 1, wherein providing the hearing aid with the antenna comprises providing a behind-the-ear (BTE) type hearing aid with the antenna.

6. The method of claim 5, wherein providing the BTE type hearing aid with the antenna comprises providing the BTE type hearing aid with a flex circuit antenna.

7. The method of claim 6, wherein providing the feed-line comprises conductors each being a metal trace on a flex circuit substrate.

8. The method of claim 7, comprising approximately minimizing a length of each of the conductors to reduce power loss.

9. The method of claim 8, comprising determining a space between the conductors by balancing between field containment and differential impedance.

10. A method for providing a hearing aid with wireless communication capabilities, comprising:

placing a parallel-loop antenna in the hearing aid, the antenna including an antenna conductor having loop portions and connecting portions each connecting between the loop portions, the loop portions each having a loop plane, the connecting portions each having a connecting plane approximately perpendicular to each of the loop planes;

placing a communication circuit in the hearing aid, the communication circuit configured to perform wireless communication using the antenna;

connecting the antenna to the communication circuit using a feed-line including feed-line conductors each having a plane; and determining geometry of the feed-line and placement of feed-line relative to the antenna to reduce capacitance resulting from crossover of conductors and to reduce electrical imbalance, including placing the feed-line relative to the antenna such that the plane of each of the feed-line conductors includes a major portion approximately perpendicular to each of the loop planes of the antenna conductor and approximately perpendicular to each of the connecting planes of the antenna conductor and such that the major portions are centered in a space between connection points between the antenna and the feed-line conductors.

11. The method of claim 10, comprising providing the feed-line including the feedline conductors each coupled between an antenna pad for making a connection to the antenna and a circuit pad for making a connection to the communication circuit.

12. The method of claim 11, wherein providing the feed-line comprises providing the feed-line with the feed-line conductors having substantially same lengths.

13. The method of claim 12, wherein providing the feed-line comprises providing the feed-line with the feed-line conductors having approximately minimum lengths determined to reduce power loss.

14. The method of claim 13, comprising placing the feed-line such that a space between the feed-line conductors is determined by balancing between field containment and differential impedance.

15. The method of claim 10, comprising providing the feed-line with the feed line conductors each being a metal trace on a flex circuit substrate.

16. The method of claim 15, comprising provide a flex circuit antenna as the antenna.

17. The method of claim 10, wherein the hearing aid comprises a behind-the-ear (BTE) type hearing aid.

* * * * *